US008713962B2

(12) United States Patent
Okazaki

(10) Patent No.: US 8,713,962 B2
(45) Date of Patent: May 6, 2014

(54) REFRIGERATING CYCLE APPARATUS

(75) Inventor: Takashi Okazaki, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 528 days.

(21) Appl. No.: 13/119,277

(22) PCT Filed: Sep. 30, 2009

(86) PCT No.: PCT/JP2009/067003

§ 371 (c)(1), (2), (4) Date: Mar. 16, 2011

(87) PCT Pub. No.: WO2010/038762

PCT Pub. Date: Apr. 8, 2010

(65) Prior Publication Data

US 2011/0203309 A1 Aug. 25, 2011

(30) Foreign Application Priority Data

Oct. 1, 2008 (JP) ..... 2008-255963

(51) Int. Cl.
*F25B 1/06* (2006.01)

(52) U.S. Cl.
USPC ..... 62/500; 62/503; 62/509

(58) Field of Classification Search
CPC ..... F25B 31/00; F25B 41/00; F25B 2341/00; F25B 2400/16; F25B 2339/044; F25B 43/00; F25B 43/006
USPC ..... 62/500, 191, 199, 197, 278, 509, 503
See application file for complete search history.

(56) References Cited

U.S. PATENT DOCUMENTS

| | | | | |
|---|---|---|---|---|
| 3,670,519 | A * | 6/1972 | Newton | 62/116 |
| 6,941,768 | B2 * | 9/2005 | Ikegami et al. | 62/500 |
| 7,066,245 | B2 * | 6/2006 | Ebara et al. | 165/202 |
| 2003/0005717 | A1 * | 1/2003 | Takeuchi et al. | 62/278 |
| 2004/0103685 | A1 | 6/2004 | Yamaguchi et al. | |
| 2005/0011221 | A1 | 1/2005 | Hirota | |
| 2008/0041079 | A1 | 2/2008 | Nishijima et al. | |
| 2009/0044564 | A1 | 2/2009 | Okamoto | |

FOREIGN PATENT DOCUMENTS

| | | | |
|---|---|---|---|
| CN | 1396422 | A | 2/2003 |
| JP | 2004-177027 | A | 6/2004 |
| JP | 2005-037093 | | 2/2005 |
| JP | 2005-076914 | A | 3/2005 |

(Continued)

OTHER PUBLICATIONS

International Search Report (PCT/ISA/210) for PCT/JP2009/067003 dated Nov. 2, 2009.

(Continued)

*Primary Examiner* — Mohammad M Ali
(74) *Attorney, Agent, or Firm* — Buchanan Ingersoll & Rooney PC

(57) ABSTRACT

To obtain a refrigerating cycle apparatus that reduces a pressure loss at the time of a normal operation in which an ejector is bypassed to improve refrigeration cycle performance. A second throttle apparatus is installed on piping path between the outlet of a condenser, which is a radiator, and the outlet of a first throttle device. A check valve is installed on piping path between a gas refrigerant suction section of the ejector and the outlet of the ejector.

7 Claims, 4 Drawing Sheets

REFRIGERANT FLOW (AT EJECTOR CYCLE OPERATION)
REFRIGERANT FLOW (AT BYPASS CYCLE OPERATION)

(56) References Cited

FOREIGN PATENT DOCUMENTS

| | | | |
|---|---|---|---|
| JP | 2005-337665 | A | 12/2005 |
| JP | 2006-105526 | A | 4/2006 |
| JP | 2006266523 | A | 10/2006 |
| JP | 2007-255817 | A | 10/2007 |
| JP | 2008-008560 | A | 1/2008 |
| JP | 2008-064447 | A | 3/2008 |
| JP | 2008-116124 | A | 5/2008 |
| WO | 2007/105440 | A1 | 9/2007 |

OTHER PUBLICATIONS

Japanese Office Action for Japanese Patent Application No. 2008-255963 dated Jan. 18, 2011.

Office Action (Notification of Reasons for Refusal) dated Oct. 4, 2011, issued in the corresponding Japanese Patent Application No. 2008-255963, and an English Translation thereof.

Chinese Office Action dated Dec. 17, 2012, with English-language translation.

Office Action (Notification of Reason of Rejection) dated Aug. 14, 2012, issued in corresponding Japanese Patent Application No. 2011-27570, and an English Translation thereof. (6 pages).

Office Action dated Apr. 3, 2012, issued in corresponding Japanese Patent Application No. 2008-255963, and an English Translation thereof. (7 pages).

Office Action (Notification of Reason of Rejection) dated Jun. 5, 2012, issued in corresponding Japanese Patent Application No. 2008-255963, and an English Translation thereof. (5 pages).

Office Action dated Jun. 7, 2012, issued in corresponding Chinese Patent Application No. 200980139014.9 and an English Translation thereof. (11 pages).

Office Action (Rejection Decision) issued on Jul. 22, 2013, by the Chinese Patent Office in corresponding Chinese Patent Application No. 200980139014.9, and an English Translation of the Office Action. (17 pages).

* cited by examiner

REFRIGERANT FLOW (AT EJECTOR CYCLE OPERATION)

REFRIGERANT FLOW (AT BYPASS CYCLE OPERATION)

REFRIGERANT FLOW (AT EJECTOR CYCLE OPERATION)

REFRIGERANT FLOW (AT BYPASS CYCLE OPERATION)

REFRIGERATING CYCLE APPARATUS

TECHNICAL FIELD

The present invention relates to a refrigerating cycle apparatus utilizing an ejector, more particularly to a refrigerant circuit configuration that switches the ejector and a general throttle device according to operation conditions.

BACKGROUND OF INVENTION

Some refrigerating cycle apparatus utilizing a prior-art ejector can operate even when ejector performance is lowered by bypassing the ejector and uses two evaporators effectively. (Refer to Patent Literature 1, for example)

With the refrigerating cycle apparatus, a first circuit is configured by a compressor 1, a radiator 2, an ejector 3, a divider 7, and a first evaporator 51 connected with a gas-liquid two-phase outlet of the divider 7 being annularly connected in order, a second circuit is configured by a liquid refrigerant outlet of the divider 7 and a suction section of the ejector 3 being connected via a first throttle device 4 and a second evaporator 52, and the refrigerant circulates through the first and the second circuits. A second throttle device 6 is provided at the piping connecting an outlet of the radiator 2 with the outlet of the first throttle device 4. When the overheating degree of the first evaporator 51 is larger than a preset value, the first throttle device 4 is closed and the second throttle device 6 is opened.

Through such a configuration, the refrigerating cycle apparatus can be provided capable of obtaining a predetermined cooling ability by effectively utilizing two evaporators even when performance is lowered by the blocking of the ejector 3.

BACKGROUND ART

Patent Literature

Patent Literature 1 Japanese Unexamined Patent Application Publication No. 2007-255817 (page 5, FIG. 1)

SUMMARY OF INVENTION

Technical Problem

With the refrigerating cycle apparatus using a prior-art ejector, in a normal operation of bypassing the ejector, performance is lowered due to pressure loss occurring while passing through the suction section of the ejector disadvantageously.

The present invention is made to solve the above-mentioned problem and its object is to reduce the pressure loss during the normal operation that bypasses the ejector to obtain the refrigerating cycle apparatus that improves performance of the refrigeration cycle.

Solution to Problem

The refrigerating cycle apparatus according to the present invention includes:

a first circuit configured by a compressor that compresses a refrigerant; a radiator that radiates and cools the refrigerant discharged from the compressor; an ejector that decompresses and expands the refrigerant output from the radiator and converts an expansion energy to a pressure energy to increase a suction pressure of said compressor; and a gas-liquid separator that separates the refrigerant output from the ejector into a gas refrigerant and a liquid refrigerant, being circularly connected in order by piping, a second circuit configured such that between a liquid refrigerant outlet of the gas-liquid separator and a suction section of the ejector is connected by piping via a first throttle device that decompresses the liquid refrigerant output from the liquid refrigerant outlet and an evaporator that evaporates the liquid refrigerant output from the first throttle device, a second throttle device that is provided on a piping path between the outlet of the radiator and the outlet of the first throttle device, and an opening and closing valve provided on the piping path between the suction section of the ejector and the outlet of the ejector. While in the bypass cycle operation using the second throttle device, no compression recovery operation of the refrigerant is performed by the ejector, in the ejector cycle operation using the first throttle device, compression recovery operation of the refrigerant is performed by the ejector.

Advantageous Effects of Invention

In the refrigerating cycle apparatus according to the present invention, pressure loss generated by passing through the suction section of the ejector is reduced and highly efficient cooling performance can be obtained in the operation with no pressure recovery operation of the refrigerant by the ejector by bypassing the ejector.

DESCRIPTION OF EMBODIMENTS

Embodiment 1

Figure 1:
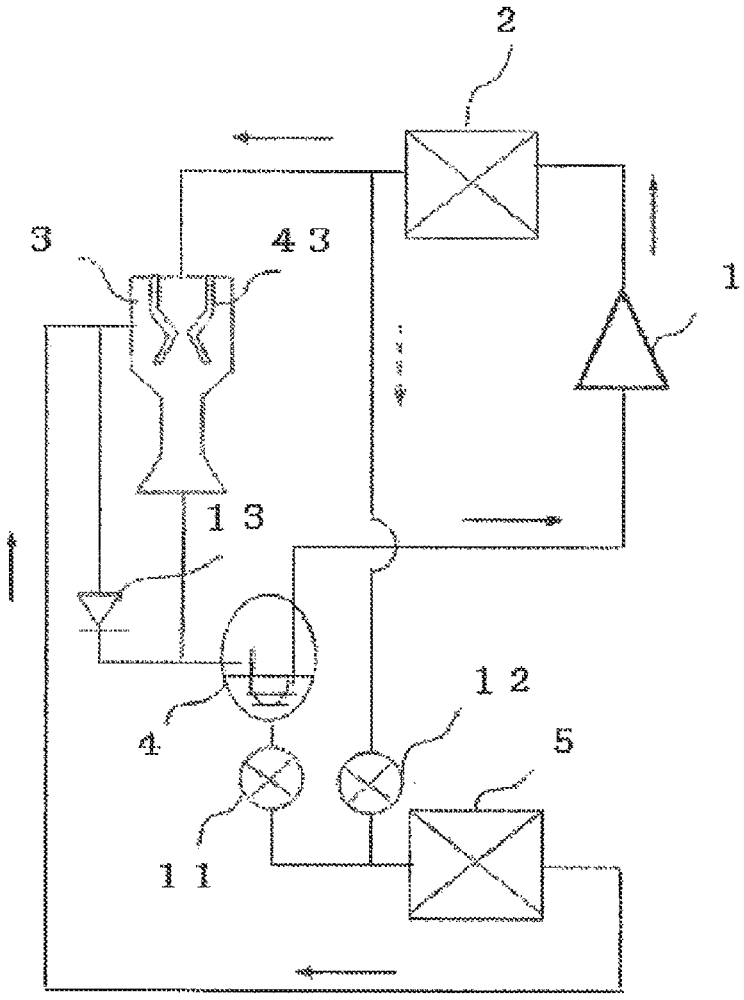
FIG. 1 is a diagram showing a configuration of the refrigerating cycle apparatus according to Embodiment 1 of the present invention.

FIG. 1 is a diagram showing a configuration of the refrigerating cycle apparatus according to Embodiment 1 of the present invention.

A compressor 1 that compresses a refrigerant, a condenser 2 which is a radiator, an ejector 3 that decompresses the refrigerant and a gas-liquid separator 4 that separates the refrigerant turned into a gas-liquid two phase flow into a gas refrigerant and a liquid refrigerant are connected in order by piping to configure a first refrigerant circuit. A liquid refrigerant outlet of the gas-liquid separator 4 and a gas refrigerant suction section 41*b* (refer to FIG. 2 to be mentioned later) of the ejector 3 are connected by piping via a first throttle device 11, which is an electronic expansion valve that decompresses the liquid refrigerant, and an evaporator 5 that evaporates the liquid refrigerant to configure a second refrigerant circuit. In these refrigerant circuits, the refrigerant is enclosed having a small global warming potential (GWP) such as HFO1234yf, whose GWP is less than 10. On the piping path between the outlet of the condenser 2 and the outlet of the first throttle device 11, second throttle device 12 is disposed, which is an electronic expansion valve. On the piping path between the gas refrigerant suction section 41*b* of the ejector 3 and the outlet of the ejector 3, a check valve 13 is disposed, for example, as an opening and closing valve.

Figure 2:
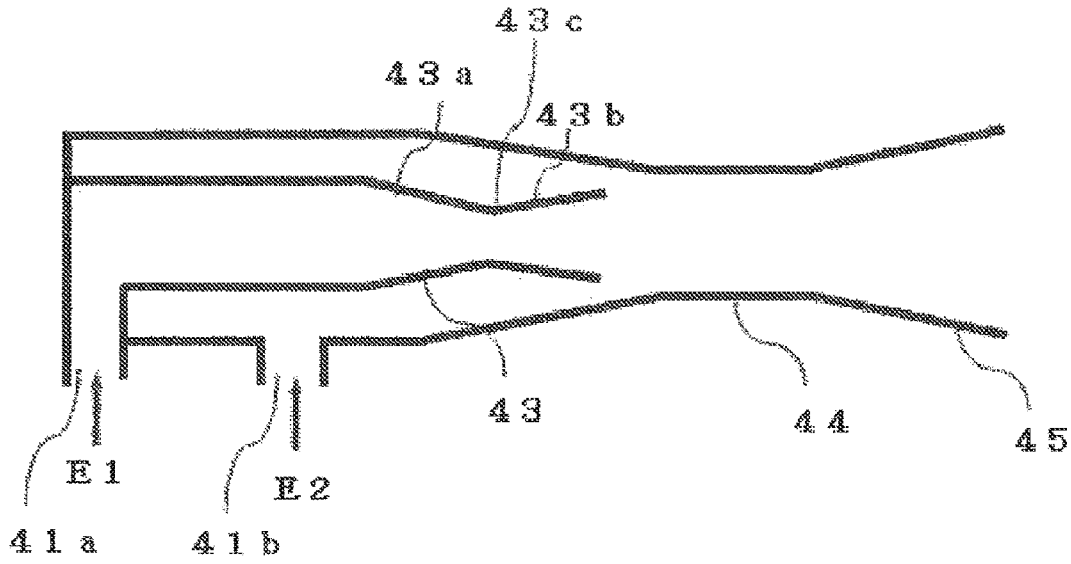
FIG. 2 is a structural diagram of the ejector of the refrigerating cycle apparatus according to Embodiment 1 of the present invention.

FIG. 2 is a structural diagram of the ejector of the refrigerating cycle apparatus according to Embodiment 1 of the present invention.

The ejector 3 is a fixed throttle structure composed of a nozzle section 43, a mixing section 44, and a diffuser section 45. The nozzle section 43 is composed of a decompression section 43*a*, a throat section 43*c*, and a diverging section 43*b*. The ejector 3 decompresses and expands the high-pressure liquid refrigerant E1, which is a driving flow flowed from the liquid refrigerant inflow section 41*a*, to turn it into a gas-liquid two-phase refrigerant in the decompression section 43*a*. In the throat section 43*c*, the flow speed of the gas-liquid two-phase refrigerant E1 is made to be a sound speed. Further, in the diverging section 43*b*, the flow speed is made to be supersonic, and finally, the gas-liquid two-phase refrigerant E1 is decompressed and accelerated. Through the gas refrigerant suction section 41*b*, the gas refrigerant E2 is sucked. Then, the gas-liquid two-phase refrigerant E1 and the gas refrigerant E2 are mixed in the mixing section 44 to be a gas-liquid two-phase refrigerant having high dryness. After recovering pressure to some degree, and further recovering pressure in the diffuser section 45, the refrigerant flows out from the ejector 3.

In the refrigerating cycle apparatus configured above, descriptions will be given to operation actions thereof while referring to FIGS. 1 and 2.

An operation (hereinafter, an ejector cycle operation) to recover the pressure of the refrigerant using the ejector 3 will be explained. In the ejector cycle operation, the second throttle apparatus 12 is set at fully closed and the check valve 13 comes to a closed state by a pressurization action in the ejector 3. The high-temperature high-pressure gas refrigerant compressed in the compressor 1 and discharged is delivered to the condenser 2. In the condenser 2 the refrigerant radiates heat to the air to be condensed, liquefied, and turned into a medium-temperature high-pressure liquid refrigerant to flow into the ejector 3. The liquid refrigerant flowed into the ejector 3 is decompressed and accelerated at the nozzle section 43 to turn into a gas-liquid two-phase refrigerant to flow into the mixing section 44. The gas-liquid two-phase refrigerant is mixed with the gas refrigerant flowed from the gas refrigerant suction section 41*b* in the mixing section 44 to turn into the gas-liquid two-phase refrigerant having high dryness. The kinetic energy as a drive flow is converted into a pressure energy and the pressure is recovered. Thereafter, the gas-liquid two-phase refrigerant further recovers pressure in the diffuser section 45 to flow out of the ejector 3. At the moment of flowing out of the ejector 3, the gas-liquid two-phase refrigerant is finally decompressed compared with the pressure of the liquid refrigerant flowed into the ejector 3, then flows into the gas-liquid separator 4. In the gas-liquid separator 4, the inflow gas-liquid two-phase refrigerant is separated into a liquid refrigerant and a gas refrigerant. The gas refrigerant flows into the compressor 1. An oil return hole (not shown) is provided in a U-shaped tube, to which the gas refrigerant returns, and accumulated oil in the gas-liquid separator 4 is returned to the compressor 1. On the other hand, the liquid refrigerant separated from the gas-liquid separator 4 flows into the evaporator 5 after being decompressed by the first throttle device 11, and absorbs heat from the air, which is media to be cooled, and evaporates to turn into a gas refrigerant and suctioned by the gas refrigerant suction section 41*b* of the ejector 3. From the above operations, the use of the ejector 3 allows the pressure of sucked the gas refrigerant of the compressor 1 to rise to perform highly efficient operation because power dissipation of the compressor 1 is reduced.

Next, an operation (hereinafter, referred to as a bypass cycle operation) will be explained that makes the refrigerant bypass using the ejector 3 without executing a pressurization action. When the evaporation temperature increases or decreases as the environmental temperature changes to cause the throttle amount in the ejector 3 to become poor or too much, and when the ejector 3 becomes blocked due to the blocking of the throat section 43*c* with refuse, the second throttle apparatus 12 is opened and the bypass cycle operation is performed using the circuit in which the ejector 3 is bypassed. Whether the throttle amount in the ejector 3 is poor or too much may be judged by, for example, the outdoor air temperature or indoor temperature, or the temperature or pressure information of each portion of the refrigerant circuit. Whether the ejector 3 becomes blocked or not may be judged by, for example, excess degree of superheat at the outlet of evaporator 5 beyond a target value. In the bypass cycle operation, the first throttle apparatus 11 is set at full close and the check valve 13 becomes an open state because no pressurization action is executed in the ejector 3. Then, the high-temperature high-pressure gas refrigerant compressed in the compressor 1 and discharged is delivered to the condenser 2. In the condenser 2, the refrigerant releases heat to the air, being condensed, liquefied, and turned into a medium-temperature high-pressure liquid refrigerant to flow into the second throttle apparatus 12. The liquid refrigerant flowed into the second throttle apparatus 12 is decompressed, flows into the evaporator 5, absorbs heat from the air, which is a medium to be cooled, to evaporate in the evaporator 5, and turns into a gas refrigerant. Thereafter, a main stream of the refrigerant passes through the check valve 13 and bypasses the ejector 3. A side stream flows in from the gas refrigerant suction section 41*b* of the ejector 3, passes through the mixing section 44 and the diffuser section 45 to flow out of the ejector 3, joins the main stream to flow into the gas-liquid separator 4. The gas refrigerant flowed into the gas-liquid separator 4 is sucked and re-compressed by the compressor 1 because the first throttle apparatus 11 is stopped. The above-mentioned operations are repeated and a general refrigeration cycle using the evaporator 5 is formed. Thereby, since an internal flow resistance of the check valve 13 is enough smaller that that from the gas refrigerant suction section 41*b* to diffuser section 45 of the ejector 3, pressure loss can be reduced.

From above-mentioned operations, in Embodiment 1 an opening closing valve (check valve 13) is provided to bypass the ejector 3 in the bypass cycle operation, therefore, pressure loss is reduced, decrease in pressure of the gas refrigerant sucked by the compressor 1 can be prevented, performance of the refrigeration cycle is improved, and COP (Coefficient Of Performance) is improved.

Since HF01234yf having a small gas density (large pressure loss) at low pressure is employed as the refrigerant, effect of preventing reduction in pressure of the refrigerant when the refrigerant reaches the suction section of the compressor 1 is larger than other refrigerant, allowing to provide a high efficiency refrigeration cycle apparatus.

It goes without saying that the internal flow resistance is designed so that the check valve according to the present embodiment is closed by pressurization amount (10 kPa, for example) of the ejector 3.

In addition, since HF01234yf that is used as the refrigerant has a small gas density at a low temperature, pressure loss is large. However, the refrigerant is not limited to HF01234yf, but a zeotropic refrigerant mixture may be used in which such as R32 is added and CWP is adjusted to be less than 500. In that case, the same effect will be exhibited.

Embodiment 2

Figure 3:
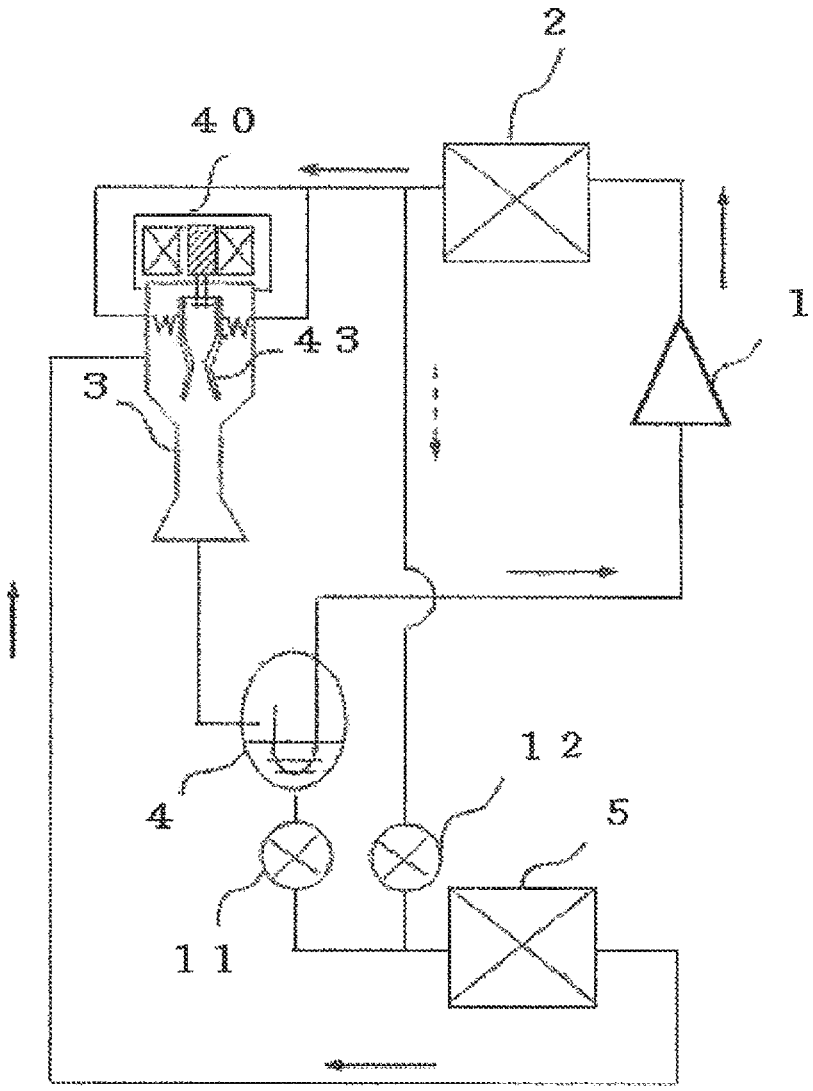
FIG. 3 is a diagram showing a configuration of the refrigerating cycle apparatus according to Embodiment 2 of the present invention.
Figure 4:
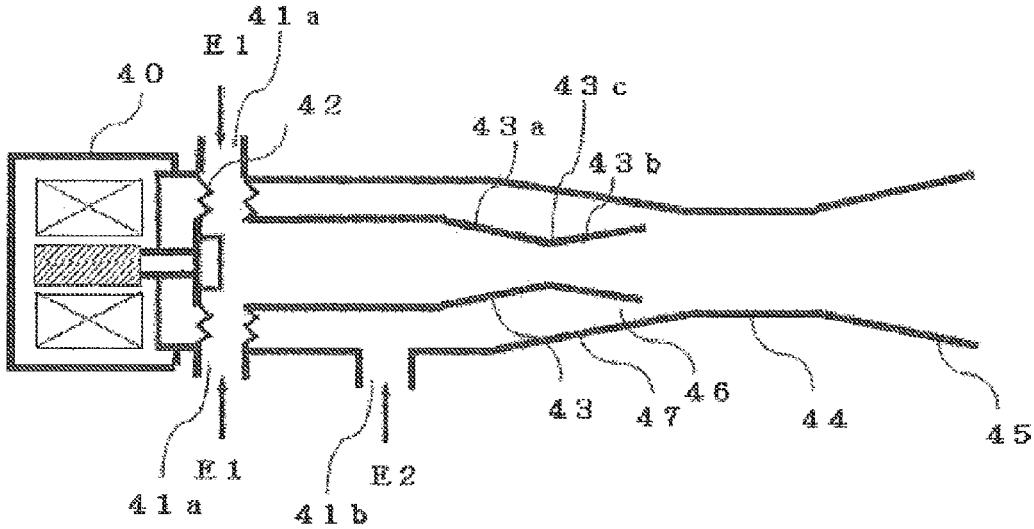
FIG. 4 is a structural diagram of the ejector of the refrigerating cycle to apparatus according to Embodiment 2 of the present invention.

FIG. 3 is a diagram showing a configuration of the refrigerating cycle apparatus according to Embodiment 2. FIG. 4 is a structural diagram of the ejector 3 of the refrigerating cycle apparatus according to Embodiment 2. Descriptions will be mainly given to configurations different from the above-mentioned Embodiment 1 in the refrigerating cycle apparatus according to Embodiment 2 shown in FIGS. 3 and 4.

As shown in FIG. 3, no opening closing valve like the check valve 13 in Embodiment 1 to bypass the ejector 3 is provided in Embodiment 2. The nozzle section 43 of the ejector 3 is connected with the electromagnetic coil 40. It is movable type and left and right two liquid refrigerant inflow sections are provided that are an inlet of the refrigerant to the nozzle section 43. As shown in FIG. 4, the ejector 3 is composed of an electromagnetic coil 40, a flexible tube 42, a nozzle section 43, a mixing section 44, and a diffuser section 45. The nozzle section 43 moves to the direction in which the distance from the inlet section of the mixing section 44 becomes large at the time of energizing the electromagnetic coil 40, and moves to the direction in which the distance from the inlet section of the mixing section 44 becomes small at the time of non-energization. Configurations and functions of each section are the same as Embodiment 1.

In the refrigerating cycle apparatus configured above, descriptions will be given to operation actions while referring to FIGS. 3 and 4. As for operation actions, descriptions will be given focusing on operations different from Embodiment 1.

In the ejector cycle operation, the electromagnetic coil 40 is not energized, and the nozzle section 43 maintains a suitable distance with the inlet section of the mixing section 44 to be a fixed state. Other operations are the same as those of the ejector cycle operation in Embodiment 1.

Next, descriptions will be given to the bypass cycle operation. When the throttle amount in the ejector 3 becomes poor or too much, and when the ejector 3 becomes blocked due to the blocking of the throat section 43*c* with refuse, the second throttle apparatus 12 is opened and the bypass cycle operation is executed using the circuit bypassing the ejector 3. In the bypass cycle operation, the electromagnetic coil 40 is energized, and by the nozzle section 43 being drawn to the electromagnetic coil 40 side, a cross-section area of the circular flow path 46 increases that is formed by an outer wall of the nozzle section 43 and an inner wall of the suction flow path wall 47. The liquid refrigerant decompressed in the second throttle apparatus 12 flows into the evaporator 5, absorbs heat from the air, which is a medium to be cooled, in the evaporator 5 to evaporate into a gas refrigerant. Thereafter, all the gas refrigerant flows in from the gas refrigerant suction section 41*b* of the ejector 3, passes through the mixing section 44 and the diffuser section 45, and flows out of the ejector 3 to flow into the gas-liquid separator 4. Then, by the electromagnetic coil 40 being energized and the nozzle section 43 being drawn to the electromagnetic coil 40 side, the cross-section area of the circular flow path 46 increases that is formed by the outer wall of the nozzle section 43 and the inner wall of the suction flow path wall 47 more than the cross-section area prior to the state where the nozzle section 43 being drawn, causing the internal flow resistance in the ejector 3 to become small to be able to reduce pressure loss.

Through the above operations, in Embodiment 2, the nozzle section 43 in the ejector 3 becomes movable by the electromagnetic coil 40. In the bypass cycle operation, pressure loss is reduced in the ejector 3 by moving the nozzle section 43 in the direction in which the cross-section area of the circular flow path 46 increases that is formed by the outer wall of the nozzle section 43 and the inner wall of the suction flow path wall 47. Thus, the pressure of the gas refrigerant sucked by the compressor 1 is prevented from lowering, the performance of the refrigeration cycle is improved, and COP (Coefficient Of Performance) is improved.

In Embodiment 2, an example is shown in which two liquid refrigerant inflow sections 41*a*, which are an inlet of the refrigerant to the nozzle section 43, are provided and displacement is absorbed by the flexible tube 42 at the time of moving the nozzle section 43. However, it is not limited thereto, but any configuration is allowable having a function of moving the nozzle section 43.

Further, in Embodiment 2, the nozzle section 43 moves to the direction in which the distance from the inlet section of the mixing section 44 becomes large at the time of energization of the electromagnetic coil 40, and moves to the direction in which the distance from the inlet section of the mixing section 44 becomes small at the time of non-energization. However, it is not limited thereto, but the moving direction of the nozzle section 43 may be reversed at the time of energization and non-energization of the electromagnetic coil 40.

REFERENCE SIGNS LIST

1 compressor
2 condenser
3 ejector
4 gas-liquid separator
5 evaporator
11 first throttle apparatus
12 second throttle apparatus
13 check valve
40 electromagnetic coil
41*a* liquid refrigerant inflow section
41*b* gas refrigerant suction section
42 flexible tube
43 nozzle section
43*a* decompression section
43*b* diverging section
43*c* throat section
44 mixing section
45 diffuser section
46 circular flow path
47 suction flow path wall

The invention claimed is:

1. A refrigerating cycle apparatus, comprising:

a first circuit configured by a compressor that compresses a refrigerant; a radiator that radiates and cools said refrigerant discharged from said compressor; an ejector that decompresses and expands said refrigerant output from said radiator and converts an expansion energy to a pressure energy to increase a suction pressure of said compressor; and a gas-liquid separator that separates said refrigerant output from said ejector into a gas refrigerant and a liquid refrigerant, being circularly connected in order by piping, a second circuit configured such that between a liquid refrigerant outlet of said gas-liquid separator and a suction section of said ejector is connected by piping via a first throttle device that decompresses said liquid refrigerant output from said liquid refrigerant outlet and an evaporator that evaporates said liquid refrigerant output from said first throttle device, a second throttle device that is provided on a piping path between the outlet of said radiator and the outlet of said first throttle device, and an opening and closing valve provided on the piping path between the suction section of said ejector and the outlet of said ejector, wherein while in a bypass cycle operation using said second throttle device, no pressure recovery operation of said refrigerant is performed by said ejector, in an ejector cycle operation using said first throttle device, pressure recovery operation of said refrigerant is performed by said ejector.

2. The refrigerating cycle apparatus of claim 1, wherein said opening and closing valve becomes an open state at the time of said bypass cycle operation and a closed state at the time of said ejector cycle operation.

3. The refrigerating cycle apparatus of claim 1, wherein a check valve is provided as said opening and closing valve and said check valve passes said refrigerant only in the direction from the suction section of said ejector to the outlet thereof.

4. The refrigerating cycle apparatus of claim 2, wherein at the time of said bypass cycle operation, part of said refrigerant passes through said opening and closing valve, and the remaining refrigerant flows in from the suction section of said ejector to flow out of the outlet thereof.

5. The refrigerating cycle apparatus of claim 1, wherein as said refrigerant, the refrigerant having a global warming potential (GWP) of less than 10 is employed.

6. The refrigerating cycle apparatus of claim 1, wherein as said refrigerant, a zeotropic refrigerant mixture having the global warming potential (GWP) of less than 500 is employed.

7. The refrigerating cycle apparatus of claim 3, wherein at the time of said bypass cycle operation, part of said refrigerant passes through said opening and closing valve, and the remaining refrigerant flows in from the suction section of said ejector to flow out of the outlet thereof.

* * * * *